US010641503B2

(12) United States Patent
Lin et al.

(10) Patent No.: US 10,641,503 B2
(45) Date of Patent: May 5, 2020

(54) PUSH-OUT MECHANISM FOR WIND DEFLECTOR AND AIR CONDITIONER

(71) Applicant: GREE ELECTRIC APPLIANCES, INC. OF ZHUHAI, Zhuhai, Guangdong (CN)

(72) Inventors: Qinghui Lin, Zhuhai (CN); Chunjie Wang, Zhuhai (CN); Guanghui Xia, Zhuhai (CN); Peng Han, Zhuhai (CN)

(73) Assignee: GREE ELECTRIC APPLIANCES, INC. OF ZHUHAI, Zhuhai, Guangdong (CN)

( * ) Notice: Subject to any disclaimer, the term of this patent is extended or adjusted under 35 U.S.C. 154(b) by 128 days.

(21) Appl. No.: 15/776,103

(22) PCT Filed: Sep. 8, 2016

(86) PCT No.: PCT/CN2016/098434
§ 371 (c)(1),
(2) Date: May 15, 2018

(87) PCT Pub. No.: WO2017/107574
PCT Pub. Date: Jun. 29, 2017

(65) Prior Publication Data

US 2018/0328599 A1 Nov. 15, 2018

(30) Foreign Application Priority Data

Dec. 21, 2015 (CN) ..... 2015 1 0975928

(51) Int. Cl.
*F24F 1/0011* (2019.01)
*F24F 13/14* (2006.01)
(Continued)

(52) U.S. Cl.
CPC ..... *F24F 1/0011* (2013.01); *F24F 1/02* (2013.01); *F24F 13/10* (2013.01); *F24F 13/1426* (2013.01); *F24F 2013/1446* (2013.01)

(58) Field of Classification Search
CPC .. F24F 1/0011; F24F 1/02; F24F 13/10; F24F 13/1426; F24F 13/20; F24F 13/06
See application file for complete search history.

(56) References Cited

U.S. PATENT DOCUMENTS 4,173,845 A * 11/1979 Heesch ..... E05F 11/382 49/350
7,735,802 B2 * 6/2010 Akabane ..... F24F 13/1426 251/129.11
2005/0097915 A1 * 5/2005 Joo ..... F24F 1/0011 62/408

FOREIGN PATENT DOCUMENTS

CN 203518158 U 4/2014
CN 104279625 A 1/2015
(Continued)

OTHER PUBLICATIONS

WIPO, International Search Report dated Dec. 15, 2016.

*Primary Examiner* — Elizabeth J Martin
(74) *Attorney, Agent, or Firm* — Li & Cai Intellectual Property (USA) Office

(57) ABSTRACT

Provided is a push-out mechanism for a wind deflector, including: a mounting housing; a rack slidably provided on the mounting housing, the rack is used to hinge with a wind deflector; a gear rotatably provided on the mounting housing and used to connect with an output shaft of a motor, the gear is engaged with the rack; an intermittent movement mechanism rotatably provided on the mounting housing, the intermittent movement mechanism including a first driving medium rotating coaxially with the gear, and a second driving medium drivingly connected with the first driving
(Continued)

medium; and a connecting rod, one end of the connecting rod is hinged to the second driving medium and the other end is used to hinge with the wind deflector. Also provided is an air conditioner. The mechanism reduces usage of a motor and saves costs.

20 Claims, 3 Drawing Sheets

(51) Int. Cl.
*F24F 1/02* (2019.01)
*F24F 13/10* (2006.01)

(56) References Cited

FOREIGN PATENT DOCUMENTS

| | | | |
|---|---|---|---|
| CN | 104515206 | A | 4/2015 |
| CN | 105423522 | A | 3/2016 |
| CN | 205227728 | U | 5/2016 |
| JP | 2002228249 | A | 8/2002 |

* cited by examiner

PUSH-OUT MECHANISM FOR WIND DEFLECTOR AND AIR CONDITIONER

CROSS-REFERENCE TO RELATED APPLICATIONS

The present application claims benefit of Chinese Patent Application No. 201510975928.6, entitled "push-out mechanism for wind deflector and air conditioner", filed to China Patent Office on Dec. 21, 2015, the contents of which are hereby incorporated by reference in its entirety.

TECHNICAL FIELD

The present invention relates to a technical field of air conditioners, and more particularly to a push-out mechanism for a wind deflector and an air conditioner.

BACKGROUND

With the improvement of the quality of life of people, air conditioners have entered millions of households and become necessary electrical appliances for homes and businesses.

At present, a wind deflector of an air conditioner is mainly divided into two types: a non-totally enclosed wind deflector and a totally enclosed wind deflector. When the air conditioner operates in a refrigerating mode, the wind deflector needs to receive wind on a front surface and a back surface at the same time, so that condensation does not occur easily. Therefore, a lower side of the wind deflector needs to have a certain gap. Because the non-totally enclosed wind deflector has the gap, it is less prone to occur condensation, and a movement route of the wind deflector is less demanding. As long as the wind deflector swings, there will be a gap when the wind deflector is opened. However, due to the presence of the gap, the air conditioner is of a lower grade.

In order to improve the grade of air conditioners to visually give people a clean atmosphere, a totally enclosed wind deflector emerged. The existing totally enclosed wind deflector has a more mature push-out mechanism for a wind deflector. After the wind deflector is pushed out by a left motor and a right motor, an up-down wind-sweeping function is achieved by another motor. In general, the push-out mechanism for a wind deflector has a left wind deflector push-out action motor, a right wind deflector push-out action motor and a wind deflector up-down wind-sweeping action motor, that is, at least three motors work, thereby resulting in high manufacturing cost.

Therefore, how to decrease a number of motors and reduce a manufacturing cost has become a technical problem urgently solved by those skilled in the art.

SUMMARY

In view of this, an objective of the present invention is to provide a push-out mechanism for a wind deflector, used to decrease the number of motors and reduce the manufacturing cost.

Another objective of the present invention is to provide an air conditioner.

To achieve the above objectives, the present invention provides technical solutions as follows.

A push-out mechanism for the wind deflector comprises:

a mounting housing;

a rack slidably provided on the mounting housing, the rack is used to hinge with a wind deflector and drive the wind deflector to push out forward;

a gear rotatably provided on the mounting housing and used to connect with an output shaft of a motor, the gear is engaged with the rack;

an intermittent movement mechanism rotatably provided on the mounting housing, the intermittent movement mechanism comprises a first driving medium rotating coaxially with the gear, and a second driving medium drivingly connected with the first driving medium; and a connecting rod, one end of the connecting rod is hinged to the second driving medium and the other end is used to hinge with the wind deflector, when the intermittent movement mechanism moves, the second driving medium and the rack drive the wind deflector to open to a corresponding angle, and when the intermittent movement mechanism stops, the rack drives the wind deflector to continuously open to a final angle.

Preferably, in the above-mentioned push-out mechanism for the wind deflector, the first driving medium is a grooved wheel; and the second driving medium is a drive plate with a cylindrical pin.

Preferably, in the above-mentioned push-out mechanism for the wind deflector, the first driving medium is a grooved wheel having at least one groove.

Preferably, in the above-mentioned push-out mechanism for the wind deflector, the intermittent movement mechanism is an incomplete gear mechanism.

Preferably, in the above-mentioned push-out mechanism for the wind deflector, the first driving medium is an incomplete gear; and the second driving medium is an incomplete gear or an incomplete rack.

Preferably, the above-mentioned push-out mechanism for the wind deflector further comprises a guide mechanism provided on the mounting housing and used to guide the rack.

Preferably, in the above-mentioned push-out mechanism for the wind deflector, the guide mechanism is a guide wheel rotatably provided on the mounting housing.

Preferably, in the above-mentioned push-out mechanism for the wind deflector, the rack is an arc-shaped rack, and an arc-shaped groove concentric with the rack is provided on the rack, the push-out mechanism for a wind deflector comprises a plurality of guide wheels, at least one of the guide wheels is matched with the arc-shaped groove; and the other one of the guide wheels are matched with an edge of the rack.

Preferably, in the above-mentioned push-out mechanism for the wind deflector, a guide groove is provided on an outer circumferential surface of the guide wheel, the rack is matched with the guide groove.

An air conditioner comprises a push-out mechanism for a wind deflector, the push-out mechanism for the wind deflector is the push-out mechanism for the wind deflector as any one of the contents described above.

It can be seen, from the above technical solution, that the push-out mechanism for the wind deflector provided by the present invention drives the first driving medium and the gear synchronous therewith through a motor, and may drive the rack to move when the gear and the first driving medium rotate synchronously. The partial push-out action of the wind deflector is achieved, so that the wind deflector moves towards an outside, close to a middle position, of a wind outlet as far as possible to generate a gap, and an axis of the wind deflector is driven by the rack to displace, thereby achieving the transition from a totally enclosed wind deflector to an opened wind deflector. The first driving medium will drive the second driving medium to rotate until the second driving medium temporarily loses the slave power of the motor. At this time, the push-out and opening stroke of the wind deflector has been completed. When the second driving medium loses the motor power, the wind deflector may be continuously opened under a power action of the rack. However, the second driving medium has no power to be applied to the wind deflector, but works under an indirect connection of a connecting rod by serving as a rotation center of the wind deflector. When the motor moves clockwise and counterclockwise under the control of a program, it is a wind-sweeping action of the wind deflector. When the wind deflector may reversely circulate according to a principle of the push-out mechanism for the wind deflector, the wind deflector will be closed. The present invention may push a wind deflector out by means of a left motor and a right motor and may achieve an up-down wind-sweeping action on the wind deflector, thereby saving the cost of one motor.

BRIEF DESCRIPTION OF THE DRAWINGS

In order to more clearly describe the technical solutions in the embodiments of the present invention or the prior art, accompanying drawings needing to be used in the descriptions of the embodiments or the related art will be briefly introduced below. Obviously, the drawings described below are merely some embodiments of the present invention. Without making creative works, a person of ordinary skill in the art may also obtain other drawings according to these drawings.

Herein, 100 is a rack, 101 is a first hinge shaft, 102 is an arc-shaped groove, 200 is a gear, 300 is a first driving medium, 400 is a second driving medium, 401 is a cylindrical pin, 500 is a connecting rod, 501 is a hinge shaft, 502 is a second hinge shaft, 600 is a guide wheel, 700 is a wind deflector, and 800 is a mounting housing.

DETAILED DESCRIPTION OF THE EMBODIMENTS

The core of the present invention is to provide a push-out mechanism for a wind deflector, used to decrease the number of motors and reduce the manufacturing cost.

Another core of the present invention is to provide an air conditioner.

Hereinafter, embodiments will be described with reference to the drawings. In addition, the embodiments shown below do not limit the content of the invention described in the claims. In addition, the entire content of the structure shown by the following embodiments is not limited to what is necessary for the solution of the invention described in the claims.

Figure 1:
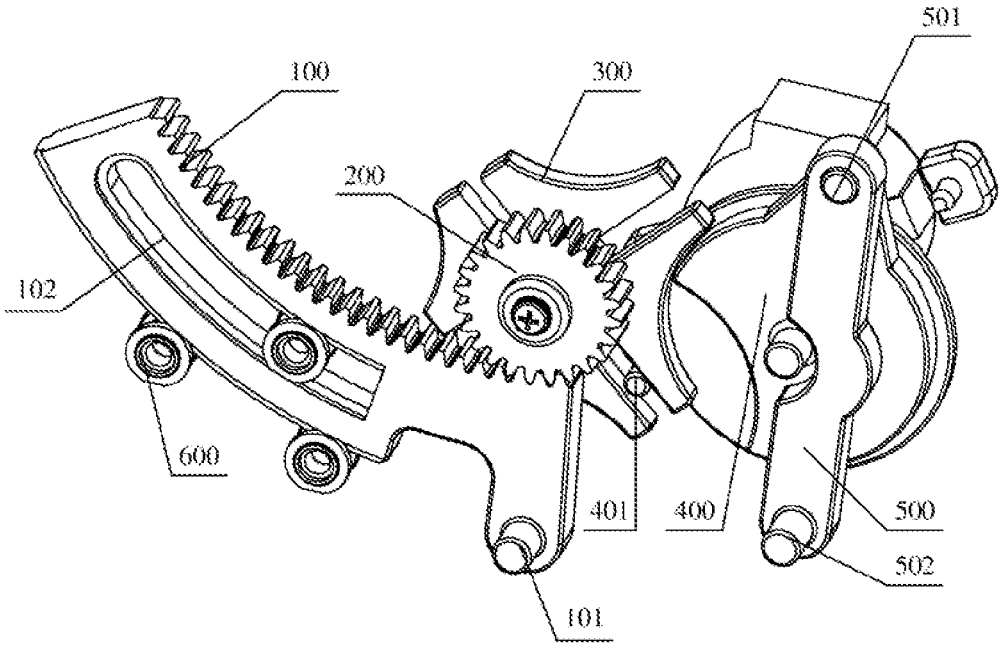
FIG. 1 is a structural schematic diagram of a push-out mechanism for a wind deflector according to an embodiment of the present invention.
Figure 2:
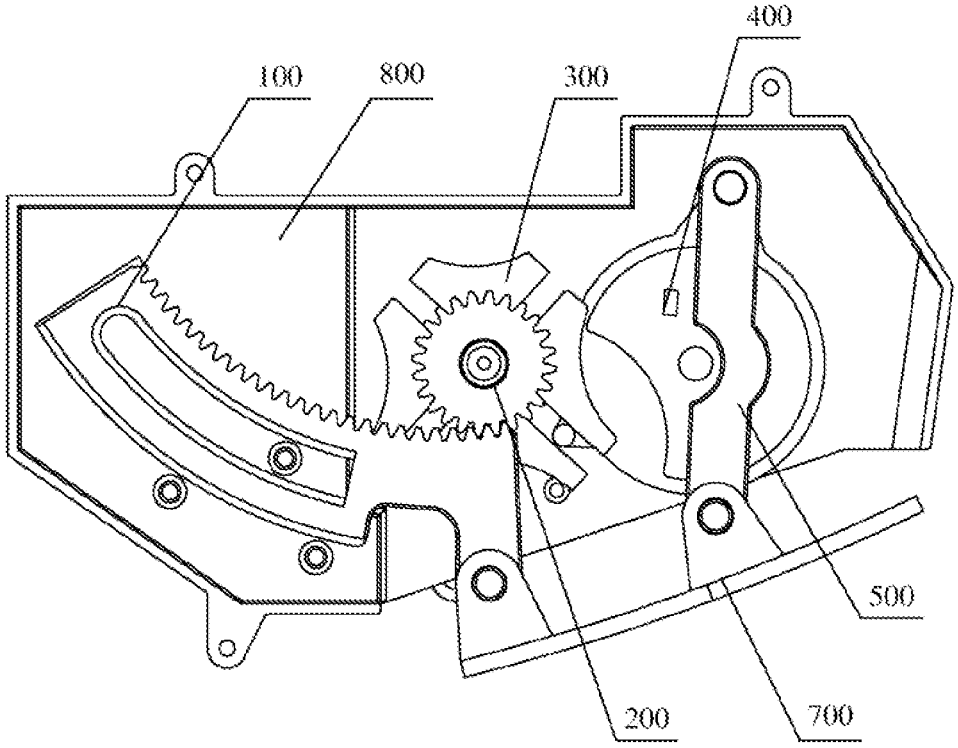
FIG. 2 is a structural schematic diagram of the push-out mechanism for the wind deflector under a closed state according to an embodiment of the present invention.
Figure 3:
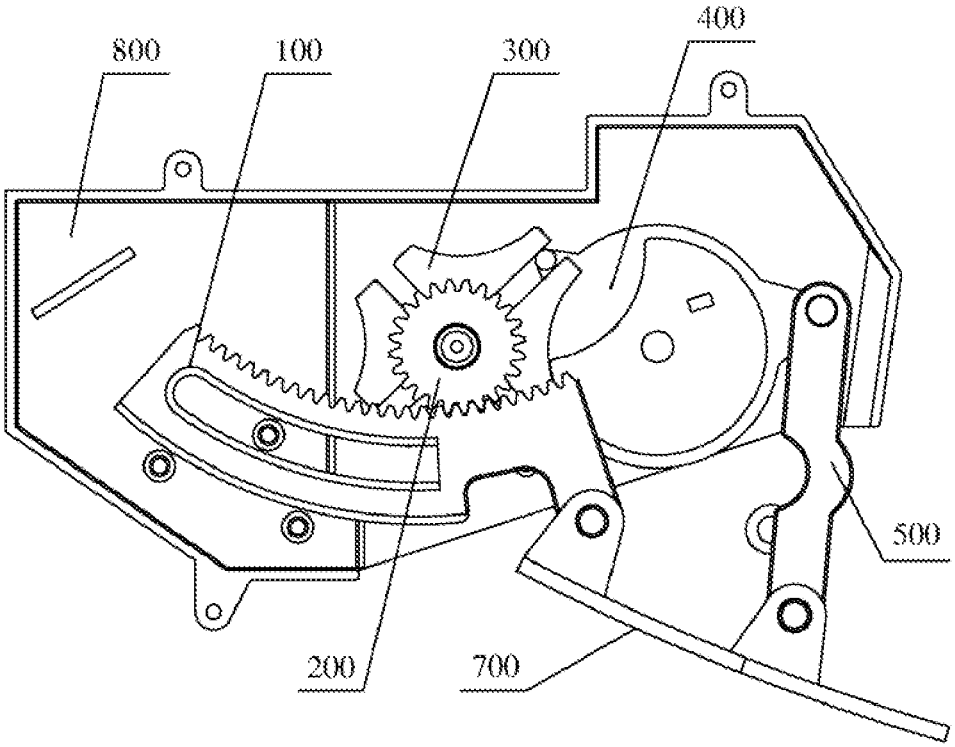
FIG. 3 is a structural schematic diagram of the push-out mechanism for the wind deflector during an opening process according to an embodiment of the present invention.
Figure 4:
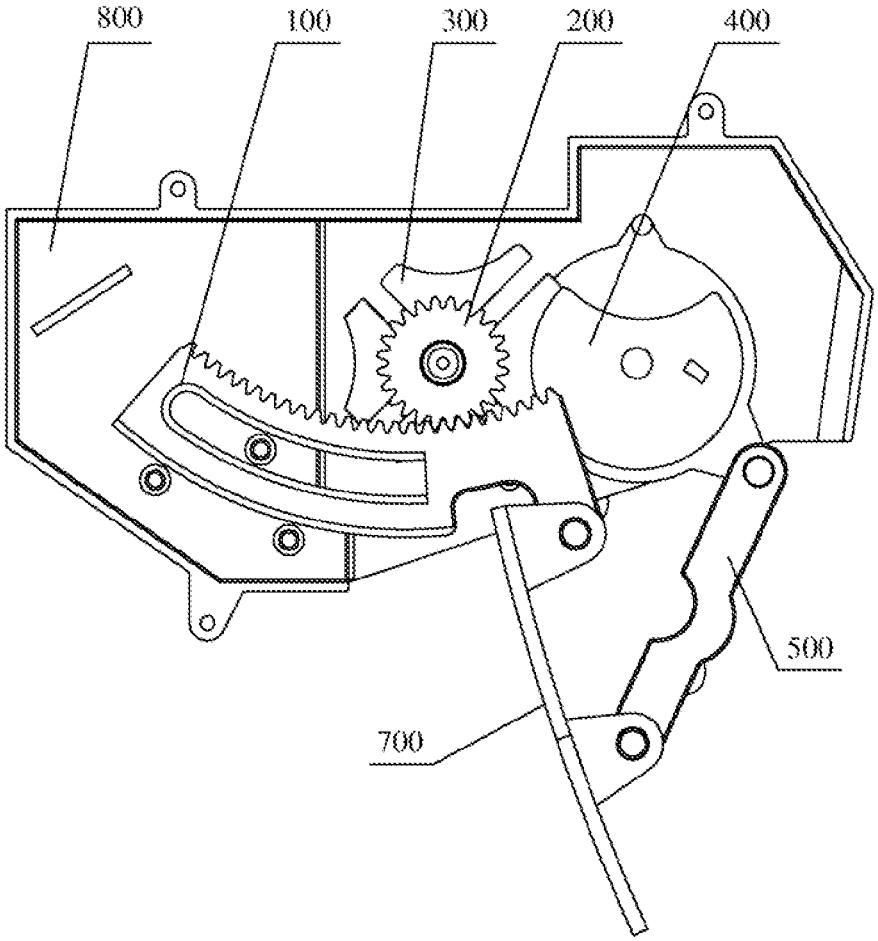
FIG. 4 is a structural schematic diagram of the push-out mechanism for the wind deflector under a totally opened state according to an embodiment of the present invention.

Please refer to FIG. 1 to FIG. 3, FIG. 1 is a structural schematic diagram of a push-out mechanism for the wind deflector according to an embodiment of the present invention; FIG. 2 is a structural schematic diagram of a push-out mechanism for the wind deflector under a closed state according to an embodiment of the present invention; FIG. 3 is a structural schematic diagram of a push-out mechanism for the wind deflector during an opening process according to an embodiment of the present invention; and FIG. 4 is a structural schematic diagram of a push-out mechanism for the wind deflector under a totally opened state according to an embodiment of the present invention.

The push-out mechanism for the wind deflector provided by the embodiment of the present invention comprises a mounting housing 800, a rack 100, a gear 200, an intermittent movement mechanism, and a connecting rod 500.

Herein, the mounting housing 800 is a supporting component of the push-out mechanism for the wind deflector, for providing a mounting base for other components.

The rack 100 is slidably provided on the mounting housing 800. The rack 100 is used for hinging with a wind deflector 700. Specifically, a first hinge shaft 101 for hinging with the wind deflector 700 is provided on the rack 100. The rack 100 is used for driving the wind deflector 700 to push out forward. The gear 200 is rotatably provided on the mounting housing 800. The gear 200 is used for connecting with an output shaft of a motor, and used for outputting a power of the motor. The gear 200 is engaged with the rack 100, so as to drive the rack 100 to slide along an arc-shaped route. Therefore, the wind deflector 700 is pushed out forward, so that a gap is formed between a lower end of the wind deflector 700 and an air conditioner housing to ensure that when the wind deflector 700 swings subsequently, air conditioning wind can be received from both an upper and lower sides of the wind deflector 700 at the same time.

The rack 100 is provided according to a movement track of the wind deflector 700, and preferably may be designed as a rack of an arc-shaped structure as shown in FIG. 1. The arc-shaped rack can achieve a displacement of a space state of the wind deflector 700, and is more conducive to space layout and less space occupation. Of course, racks with other structures such as a straight structure may also be used, and the present invention does not limit a specific shape of the rack.

The intermittent movement mechanism is rotatably provided on the mounting housing 800. The intermittent movement mechanism comprises a first driving medium 300 rotating coaxially with the gear 200 and a second driving medium 400 drivingly connected with the first driving medium 300. The first driving medium 300 is rotated by the motor, and the second driving medium 400 is rotated by the first driving medium 300. The intermittent movement mechanism can convert the continuous rotation of the first driving medium 300 into a periodic movement and a stop of the second driving medium 400.

One end of the connecting rod 500 is hinged to the second driving medium 400. Specifically, the connecting rod 500 is hinged with the second driving medium 400 through a hinge shaft 501 provided on the connecting rod 500. The other end of the connecting rod 500 is used for hinging with the wind deflector 700. Correspondingly, a second hinge shaft 502 for hinging with the wind deflector 700 is provided on the connecting rod 500. When the intermittent movement mechanism moves, the second driving medium 400 and the rack 100 drive the wind deflector 700 to open to a corresponding angle, and when the intermittent movement mechanism stops, the rack 100 drives the wind deflector 700 to continuously open to a final angle.

As shown in FIG. 2, the push-out mechanism for the wind deflector provided by the present invention drives the first driving medium 300 and the gear 200 synchronous therewith through the motor, and may drive the rack 100 to move when the gear 200 and the first driving medium 300 rotate synchronously. The partial push-out action of the wind deflector 700 is achieved, so that the wind deflector 700 moves towards an outside, close to a middle position, of a wind outlet as far as possible to generate a gap, and an axis of the wind deflector 700 is driven by the rack 100 to displace, thereby achieving a transition from a totally enclosed wind deflector to an opened wind deflector.

As shown in FIG. 3, the first driving medium 300 will drive the second driving medium 400 to rotate until the second driving medium 400 temporarily loses the slave power of the motor. At this time, a push-out and opening stroke of the wind deflector 700 has been completed.

As shown in FIG. 4, when the second driving medium 400 loses the motor power, the wind deflector 700 may be continuously opened under a power action of the rack 100. However, the second driving medium 400 has no power to be applied to the wind deflector 700, but works under an indirect connection of the connecting rod 500 by serving as a rotation center of the wind deflector 700. When the motor moves clockwise and counterclockwise under the control of a program, it is a wind-sweeping action of the wind deflector 700. When the wind deflector 700 may reversely circulate according to a principle of the push-out mechanism for the wind deflector, the wind deflector 700 will be closed. The present invention may push the wind deflector 700 out by means of a left motor and a right motor and may achieve an up-down wind-sweeping action on the wind deflector, thereby saving the cost of one motor.

In a specific embodiment of the present invention, the intermittent movement mechanism is a grooved wheel mechanism, the first driving medium 300 is a grooved wheel, and the second driving medium 400 is a drive plate with a cylindrical pin 401. The first driving medium 300 is a grooved wheel having at least one groove, and the grooved wheel as shown in FIG. 1 is a grooved wheel having four grooves. It should be noted that according to the required movement track, the structure of the grooved wheel may be freely designed. When the grooved wheel mechanism is actuated, it is used as a driving mechanism to drive the wind deflector 700 to push out. When the grooved wheel mechanism stops, that is, when the cylindrical pin 401 leaves the groove of the grooved wheel, it is converted into a driven mechanism for operation.

In a specific embodiment of the present invention, the intermittent movement mechanism is an incomplete gear mechanism, and the incomplete gear mechanism is also a common intermittent movement mechanism. In a driving gear, only one or a few teeth are made, gear teeth engaged with the driving gear are made on a driven gear according to the requirements of movement time and stop time, and others are locking arcs. When two gear teeth come into engagement, as in a case of gear drive, a toothless portion is positioned by the locking arc, so that the driven gear is stationary.

It should be noted that the first driving medium 300 is an incomplete gear, and the second driving medium 400 may be an incomplete gear or an incomplete rack. For the intermittent movement mechanism, an internal gear, an external gear, an internal rack, an external rack, an inner grooved wheel, an outer grooved wheel and like may be selected as required.

In order to ensure smooth sliding of the rack 100, the embodiment of the present invention further comprises a guide mechanism provided on the mounting housing 800 and used to guide the rack 100. The arrangement of the guide mechanism should be set according to a movement route of the rack 100 to ensure that the rack 100 smoothly slides along a predetermined route.

In the present embodiment, the guide mechanism is a guide wheel 600 rotatably provided on the mounting housing 800. That is, the guide wheel and the rack 100 are in rolling friction, and the friction is smaller, which is more conducive to the sliding of the rack 100.

Further, the rack 100 is an arc-shaped rack, and an arc-shaped groove 102 concentric with the rack 100 is provided on the rack 100, the push-out mechanism for a wind deflector comprises a plurality of guide wheels, at least one of the guide wheels 600 is matched with the arc-shaped groove 102, and the other one of the guide wheels 600 are matched with an edge of the rack 100. In the present embodiment, one guide wheel 600 is matched with the arc-shaped groove 102, and two guide wheels 600 are matched with the edge of the rack 100.

A guide groove is provided on an outer circumferential surface of the guide wheel 600, the rack 100 is matched with the guide groove. By means of the guide groove, the guide wheel 600 may not only limit the movement of the rack 100 in a direction perpendicular to an axis of the guide wheel 600, but also limit the movement of the rack 100 in a direction parallel to the axis of the guide wheel 600.

The present invention also discloses an air conditioner. The air conditioner comprises the push-out mechanism for a wind deflector disclosed in the above embodiments, and thus has all the technical effects of the above embodiments, which will not be elaborated herein again.

The above description of the disclosed embodiments enables those skilled in the art to implement or use the present invention. Various modifications to these embodiments will be readily apparent to those skilled in the art, and the general principles defined herein may be applied to other embodiments without departing from the spirit or scope of the present invention. Therefore, the present invention will not be limited to these embodiments shown herein, but it is to comply with the broadest scope consistent with the principles and novel features disclosed herein.

What is claimed is:

1. A push-out mechanism for a wind deflector, comprising:

a mounting housing;

a rack slidably provided on the mounting housing, the rack is used to hinge with a wind deflector, and drive the wind deflector to push out forward;

a gear rotatably provided on the mounting housing and used to connect with an output shaft of a motor, the gear is engaged with the rack;

an intermittent movement mechanism rotatably provided on the mounting housing, the intermittent movement mechanism comprises a first driving medium rotating coaxially with the gear, and a second driving medium drivingly connected with the first driving medium; and a connecting rod, one end of the connecting rod is hinged to the second driving medium and the other end hinges with the wind deflector, when the first driving medium moves, the second driving medium and the rack drive the wind deflector to open to a corresponding angle, and when the first driving medium stops, the rack drives the wind deflector to continuously open to a final angle.

2. The push-out mechanism for the wind deflector as claimed in claim 1, wherein the first driving medium is a grooved wheel; and the second driving medium is a drive plate with a cylindrical pin.

3. The push-out mechanism for the wind deflector as claimed in claim 2, further comprising a guide mechanism provided on the mounting housing and used to guide the rack.

4. The push-out mechanism for the wind deflector as claimed in claim 2, wherein the first driving medium is a grooved wheel having at least one groove.

5. The push-out mechanism for the wind deflector as claimed in claim 4, further comprising a guide mechanism provided on the mounting housing and used to guide the rack.

6. The push-out mechanism for the wind deflector as claimed in claim 1, wherein the intermittent movement mechanism is an incomplete gear mechanism.

7. The push-out mechanism for the wind deflector as claimed in claim 6, further comprising a guide mechanism provided on the mounting housing and used to guide the rack.

8. The push-out mechanism for the wind deflector as claimed in claim 6, wherein the first driving medium is an incomplete gear; and the second driving medium is an incomplete gear or an incomplete rack.

9. The push-out mechanism for the wind deflector as claimed in claim 8, further comprising a guide mechanism provided on the mounting housing and used to guide the rack.

10. The push-out mechanism for the wind deflector as claimed in claim 1, further comprising a guide mechanism provided on the mounting housing and used to guide the rack.

11. The push-out mechanism for the wind deflector as claimed in claim 10, wherein the guide mechanism is a guide wheel rotatably provided on the mounting housing.

12. The push-out mechanism for the wind deflector as claimed in claim 11, wherein the rack is an arc-shaped rack, and an arc-shaped groove concentric with the rack is provided on the rack, the push-out mechanism for a wind deflector comprises a plurality of guide wheels, at least one of the guide wheels is matched with the arc-shaped groove; and the other one of the guide wheels are matched with an edge of the rack.

13. The push-out mechanism for the wind deflector as claimed in claim 11, wherein a guide groove is provided on an outer circumferential surface of the guide wheel, the rack is matched with the guide groove.

14. An air conditioner, comprising a housing and the push-out mechanism for the wind deflector as claimed in claim 1, wherein the push-out mechanism for the wind deflector is disposed in the housing.

15. The air conditioner as claimed in claim 14, wherein the first driving medium is a grooved wheel; and the second driving medium is a drive plate with a cylindrical pin.

16. The air conditioner as claimed in claim 15, wherein the first driving medium is a grooved wheel having at least one groove.

17. The air conditioner as claimed in claim 14, wherein the intermittent movement mechanism is an incomplete gear mechanism.

18. The air conditioner as claimed in claim 17, wherein the first driving medium is an incomplete gear; and the second driving medium is an incomplete gear or an incomplete rack.

19. The air conditioner as claimed in claim 14, further comprising a guide mechanism provided on the mounting housing and used to guide the rack.

20. The air conditioner as claimed in claim 19, wherein the guide mechanism is a guide wheel rotatably provided on the mounting housing.

* * * * *